United States Patent [19]

Mancini

[11] 4,213,285

[45] Jul. 22, 1980

[54] CARTONING APPARATUS

[75] Inventor: Derek V. Mancini, Etobicoke, Canada

[73] Assignee: Consumers Glass Company Limited, Etobicoke, Canada

[21] Appl. No.: 956,246

[22] Filed: Oct. 31, 1978

[51] Int. Cl.[2] ..... B65B 7/20; B65B 43/28

[52] U.S. Cl. ..... 53/137; 53/564; 53/284; 53/374; 93/36.9; 93/53 SD; 156/522

[58] Field of Search ..... 53/564, 137, 284, 374; 93/53 R, 53 SD, 36.9; 156/522

[56] References Cited

U.S. PATENT DOCUMENTS

| | | | |
|---|---|---|---|
| 3,196,591 | 7/1965 | Guido et al. | 93/36.9 X |
| 3,216,175 | 11/1965 | Stohlquist | 53/564 |
| 3,229,594 | 1/1966 | De La Coussaye . | |
| 3,442,063 | 5/1969 | Martin | 53/564 X |
| 3,617,412 | 11/1971 | Schenderling et al. | |
| 3,973,375 | 8/1976 | Loveland . | |
| 4,028,865 | 6/1977 | Loveland et al. | |
| 4,061,526 | 12/1977 | Warshaw et al. | |
| 4,073,119 | 2/1978 | Nelson | 53/137 X |

*Primary Examiner*—Travis S. McGehee

[57] ABSTRACT

The specification describes a cartoning apparatus adapted to carry out a plurality of cartoning steps which in the past have been carried out by individual independent machines. The cartoning apparatus includes a set-up station for the opening of flat carton blanks, a conveyor for advancing the opened carton blanks along the apparatus, and closure means downstream of the set-up station for closing the bottom and/or top of the carton. The closure means is adapted to both fold and tape the carton and automatically apply the required amount of tape to each carton. It includes means for applying the strip of tape extending between adjacent spaced apart cartons and a plunger member for plunging between the cartons to sever the extended strip of tape and to apply the thusly provided free tape ends to the opposing end walls of the adjacent cartons.

13 Claims, 12 Drawing Figures

FIG. 2.
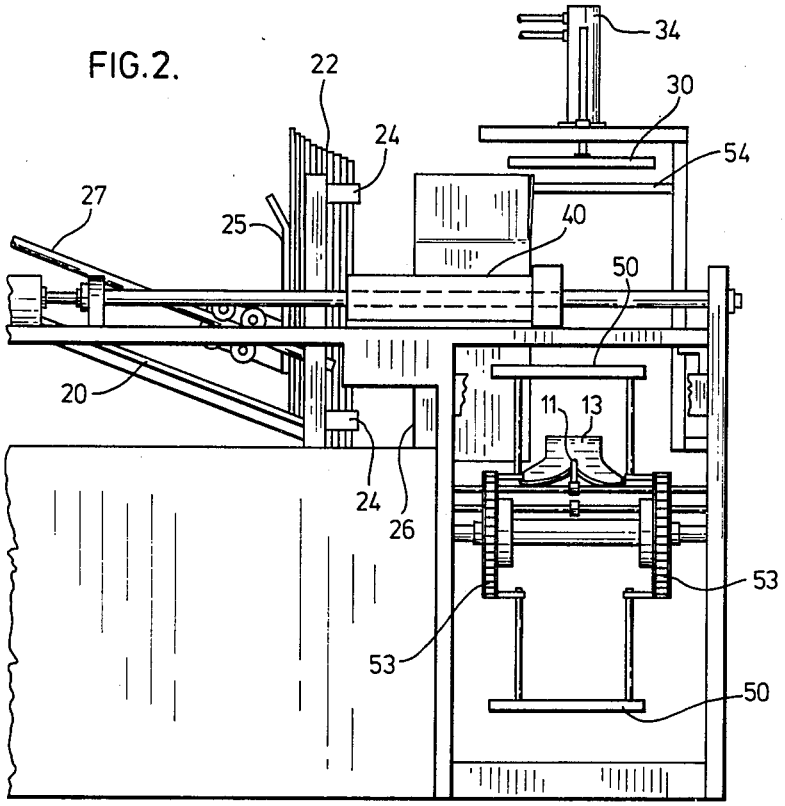
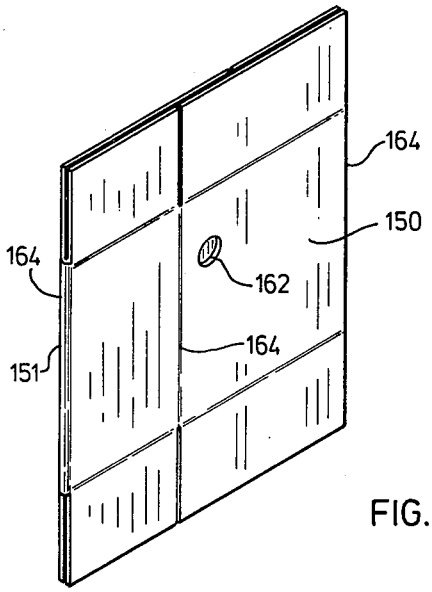
FIG. 3.

CARTONING APPARATUS

FIELD OF THE INVENTION

This invention relates to a cartoning system and more particularly to the various stations in a cartoning system.

BACKGROUND OF THE INVENTION

From the work that has been done in the packaging or cartoning industry, there has been very little development with respect to providing a single cartoning apparatus capable of carrying out the various operations required in a cartoning process. These operations are generally carried out by a plurality of independent machines which function well on their own but are difficult to marry together due to their independent nature. Two prime considerations in the packaging industry are the minimizing of labor required to operate the packaging machinery and the maximizing or making best use of available floor space. The present use of a plurality of individual machines does not produce these desired objectives since each machine takes up more space than necessary and requires supervision for its operation.

Two operations in a cartoning process, which have proved to be difficult in the past to incorporate into a complete system are the set-up of heavy duty carton blanks as well as the closure of the carton. With respect to the former stiff rigid carton blanks stored as flats, they were often opened by hand in preparation of filling. In regards to the latter, a taped closure has received wide acceptance in the packaging industry, but the taping operation again requires the use of labor to not only apply the tape to the carton, but also to measure out the amount of tape required.

The present invention overcomes many of the shortcomings of the prior art by providing a cartoning apparatus adapted to perform a plurality of cartoning operations. The opening of flat carton blanks, a conveyor for advancing the opened carton blanks along the apparatus, and closure means downstream of the set-up station for closing the bottom and/or top of the carton. In cases where the carton is prepared for filling at a later stage, only the bottom closure is made with the top of the carton being left open for later closure. In cases where the entire packaging process is carried out on one apparatus, the apparatus includes both the bottom and top closure means.

The closure means includes both folding and taping apparatus and is adapted to not only automatically apply the required amount of tape to each carton, but to also supply the tape in a manner such that a consistent length of tape is applied along the folded portion of the carton and extends around each carton end wall. In order to provide this effective closure, the taping apparatus includes means for applying a strip of tape to the bottom of folded carton flaps and extending between adjacent spaced apart cartons, and a plunger member for plunging between the cartons to sever the extended strip of tape and to apply the thusly provided free tape ends to the opposing end wall of the adjacent cartons to complete bottom closure.

BRIEF DESCRIPTION OF THE DRAWINGS

The above as well as further features of the drawings will be described in more detail as shown in the drawings, wherein:

FIG. 2 is an end section view taken along lines 2—2 of FIG. 1;

FIG. 3 is a perspective view of a carton flat;

DETAILED DESCRIPTION ACCORDING TO THE PREFERRED EMBODIMENTS OF THE INVENTION

Figure 1:
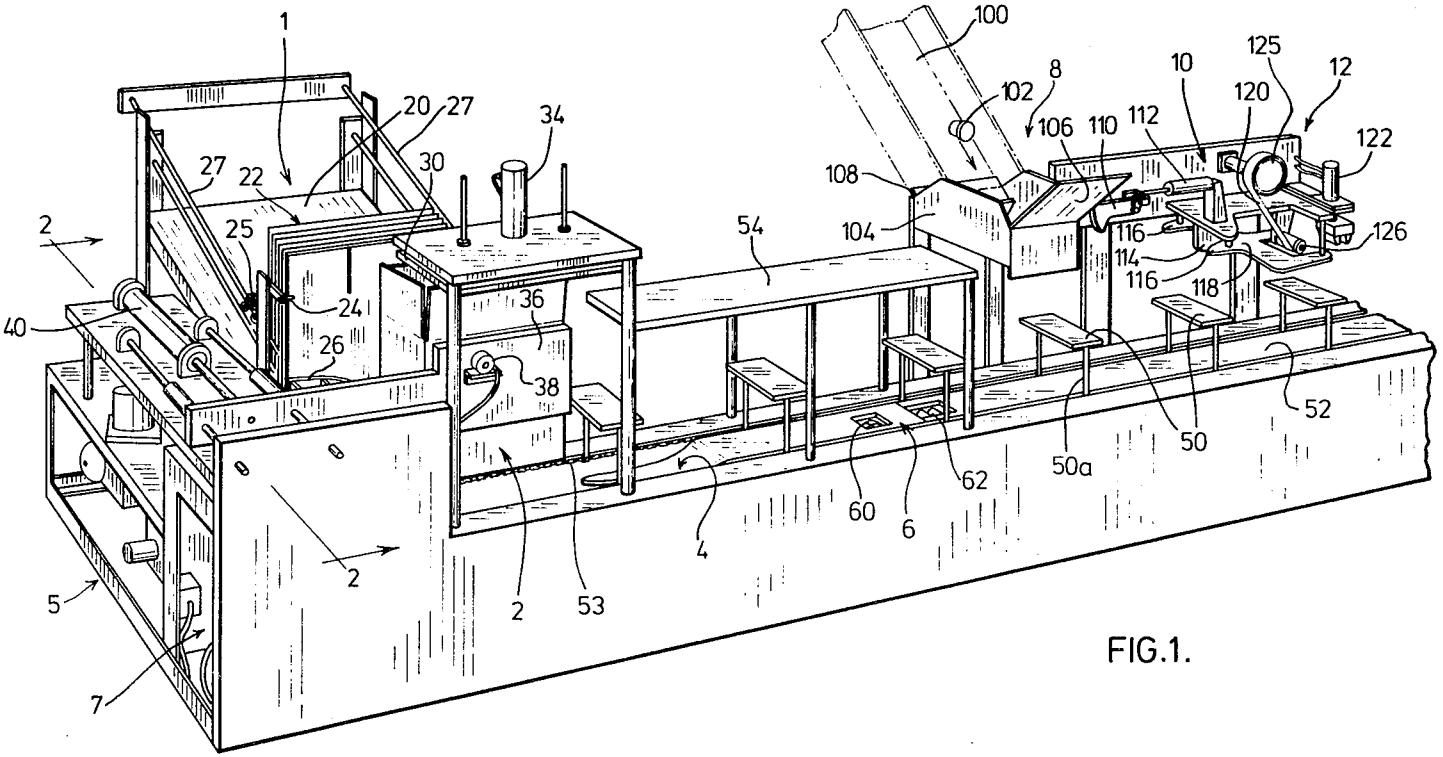
FIG. 1 is a perspective view of a preferred embodiment of the automatic cartoning apparatus according to the present invention.
Figure 4:
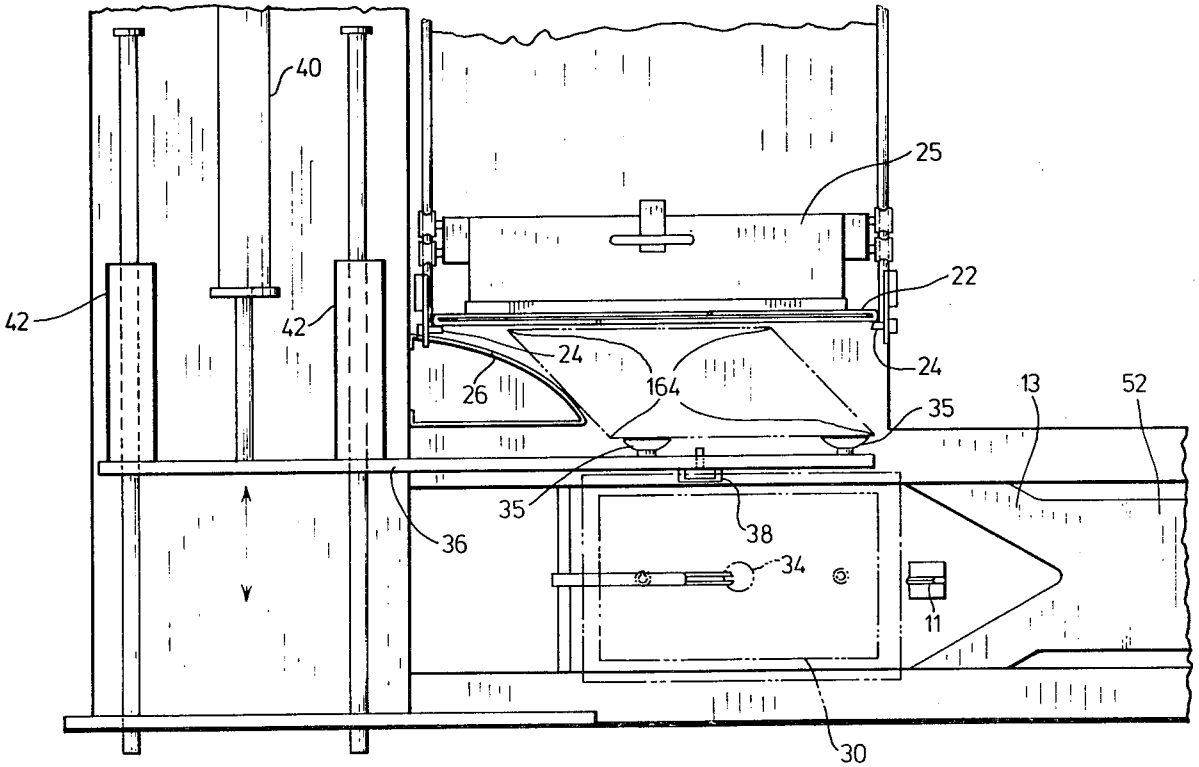
FIG. 4 is a top view of a preferred carton set-up apparatus.
Figure 5:
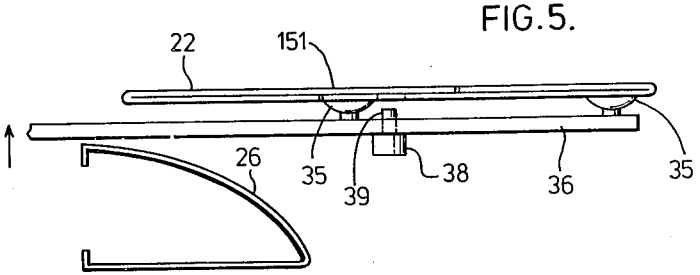
FIGS. 5 through 8 are partial top views of the carton set-up apparatus prepared for positioning on the conveyor.

FIG. 1 shows a complete cartoning system comprising a carton supply station generally indicated at 1; a carton set-up station generally indicated at 2; a lower flap closure system generally indicated at 4; a lower flap taping system generally indicated at 6; a carton filling station generally indicated at 8; an upper flap closure system generally indicated at 10; and an upper flap taping system generally indicated at 12.

The carton blank supply station located at the upstream end of the system, includes a supply chute 20 for holding a plurality of folded carton blanks 22. The supply chute is located to one side of the conveyor slightly above the conveyor bed. Provided at the end of the supply chute are a pair of positioning members 24 for positioning the carton blanks for set-up. Also provided in a supply chute is a sliding member 25, which holds the carton blanks in an upright position tightly against the positioning members and which slides down the chute along rails 27 forcing the flat carton blanks against the positioning members 24.

Figure 6:
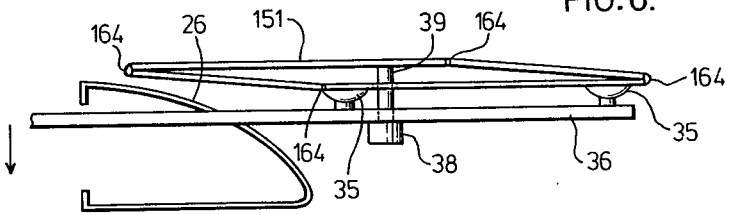
Figure 7:
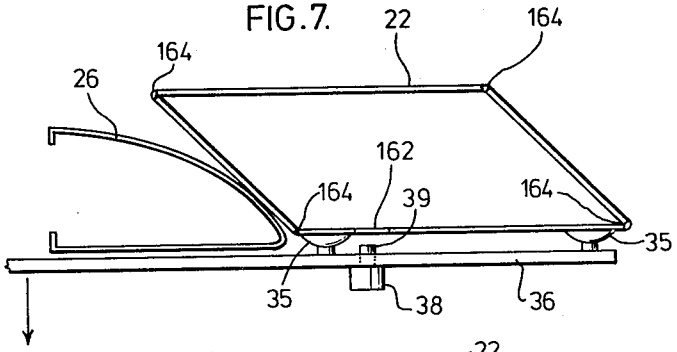
Figure 8:
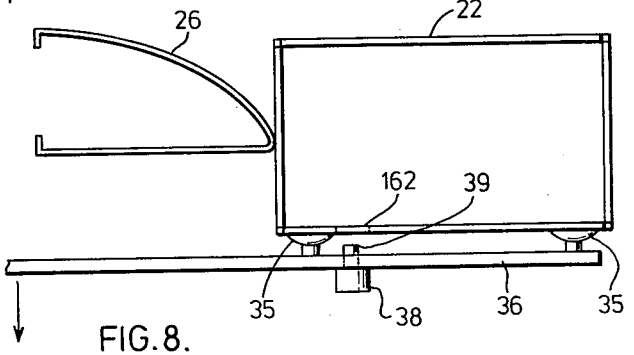

As the carton blanks are fed into the set-up station, they are opened from their flat condition. The opening of the cartoning blanks is initiated by means of a small cylinder 38 and piston 39 provided on carton blank securing arm 36 which is hydraulically or pneumatically operated by cylinder 40 to reciprocate across the set-up station. As the securing arm is advanced across the set-up station toward the carton blank, piston 39 is forced through aperture 162 provided in sidewall 150 and strikes the opposite sidewall 151. The piston is then activated to separate the sidewalls and partially open the carton blank as is best shown in FIG. 6. Aperture 162 through which piston 39 extends to effect the separation, can be seen in FIG. 3.

The opening of the carton blanks is completed through the cooperative efforts of securing arm 36 and a deflecting member 26, which is well shown in FIGS.

7 and 8. The securing arm is provided with vacuum pads 35, which releasably engage the leading sidewall of the carton blank. The securing arm is withdrawn, pulling the partially opened carton blank with it. Deflecting member 26 engages the end wall of the carton blank causing a hinging action at the corner creases 164 to complete its opening in the set-up station.

As discussed earlier a prime consideration in the packaging industry is the maximizing of available floor space and one method of achieving this is by storing the carton blanks in the flat form as shown in FIG. 3. These flats often become creased and warped and there is often a tendency for them to buckle when being opened rather than opening along the preformed corner creases 164. This is especially true in the case of corrugated carton blanks which are used for the packaging of heavy or bulky goods.

However, this problem is essentially eliminated by the use of the carton blanks opening arrangement discussed above. The provision of cylinder 38 and piston 39 provides the initial separation to partially open the blank and unfold it along the corner creases which then expose the endwall to the deflecting member 26. The proper positioning of the deflecting member at the entrance to the set-up station assures the desired contact between it and the carton endwall as the carton is drawn into the set-up station thereby providing the proper opening of the carton blank.

Located at the upper end of the set-up station is a cylinder assembly 34 provided with a plate member 30, which operates to force the open carton blank downwardly into the conveyor bed which is depressed or recessed in the area of the set-up station. With this embodiment, the recessed conveyor bed permits opening of the carton blank on the level of the carton blank supply, then pushing the open blank downwardly into the recessed portion so that when the bottom of the open blank is folded close, the formed carton bottom is aligned with the bed of the conveyor preparatory to the bottom taping operation. The conveyor is advanced in an intermittent or stop and start motion by an electric motor generally indicated at 7 in FIG. 1. The timing of the stop and start motion of the conveyor is controlled by a timing motor generally shown at 5 in FIG. 1 which also controls the timing of all component movements of the stations along the conveyor.

Conveyor 52 is driven by two drive chains 53 only one of which can be seen in FIG. 1. These are spaced on either side of the stationary bed of the conveyor. Spacing brackets 50 traverse the conveyor and are secured to the drive chains. Adjacent brackets are spaced to snugly secure an open carton blank on the conveyor.

Figure 9:
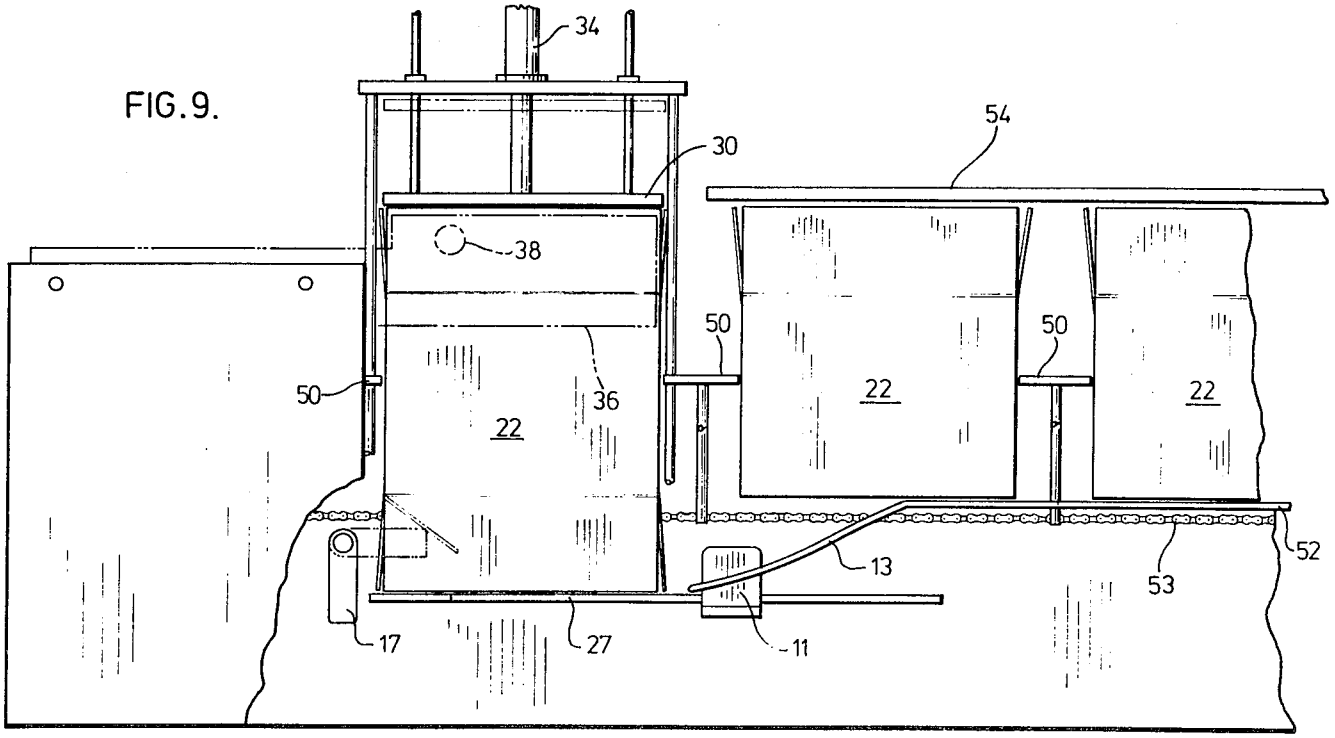
FIG. 9 is a front view of an opened carton flat positioned on the conveyor of the cartoning apparatus of FIG. 1.

FIG. 9 shows the open carton blank 22*a* positioned between two spacing brackets 50 with the carton blank forced down into the depressed area of the conveyor bed by means of plate member 30 actuated by cylinder 34. Since the conveyor bed is depressed in the set-up station, it will easily accommodate the overall height of the carton blank prior to the folding closed of both the top and bottom carton blank flaps.

The next operation is the folding of the carton bottom. Firstly, pivoting end flap closure member 17, forces the upstream bottom end flap closed. The blank is then advanced on the conveyor such that the downstream bottom end flap rides over and is closed by means of stationary upright member 11.

The bottom sidewall flaps are then closed over the end flaps by means of side flap closure member 13 positioned slightly downstream of the supply chute. This is done while the blank is advanced with the sidewall flaps camming over member 13 to complete the folding of the carton bottom.

The carton blank continues its downstream movement with its folded bottom passing over the bottom taping system which includes a free rolling tape supply 61, contact roller 60, and a tape plunger member generally indicated at 62. The supply of tape consists preferably of pressure sensitive adhesive on one side of the tape web. The other side of tape web is coated with a material which facilitates release of the tape from the supply as the tape is unrealed during the taping operation. Such release material may be silicone or the like.

An upper support plate 54 is located above the bottom taping system spaced from the conveyor bed for prohibiting upward movement of the carton blanks during the bottom taping operation.

Figure 11:
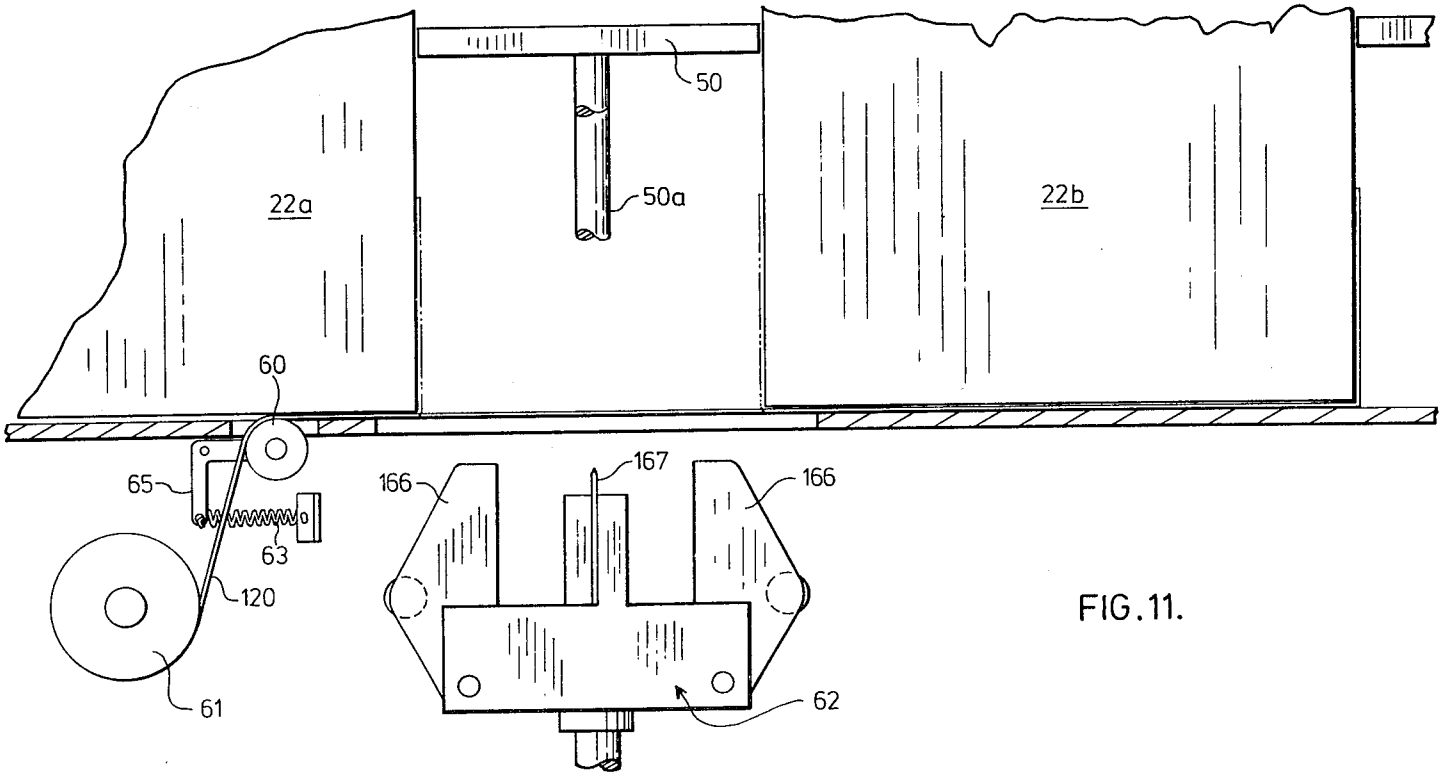
FIG. 11 is a detailed view of a preferred arrangement of the lower taping system.

Referring to FIG. 11, as the carton blanks are moved downstream along the conveyor, they are forced over the contact roller 60, which extends slightly above the conveyor bed. Tape 120 relaed off supply 61 is applied along the bottom seam while the conveyor is moving by the contact roller, which is spring biased upwardly by means of spring 63 and pivoted bracket 65. FIG. 11 also shows that a strip of tape extending between carton blanks 22*c* and 22*b* is applied along the bottom seam of carton 22*c* as well as approximately the first three inches of the bottom seam of carton 22*b*. At this point, the timing device functions to stop the conveyor and operate the tape plunger.

Tape plunger member 62 is hydraulically or pneumatically operated and remains below the conveyor bed while the conveyor is in motion. The proper controlling and timing of the conveyor positions the carton blanks such that the tape plunger is aligned with the spaces between the cartons when the conveyor is stationary, which is also shown in FIG. 11. The space between adjacent cartons is formed by plate 50 as supported by posts 50*a* to each side of the conveyor bed. Such an arrangement allows the plunger 62 to move upwardly unimpeded to effect endwall taping.

Figure 12:
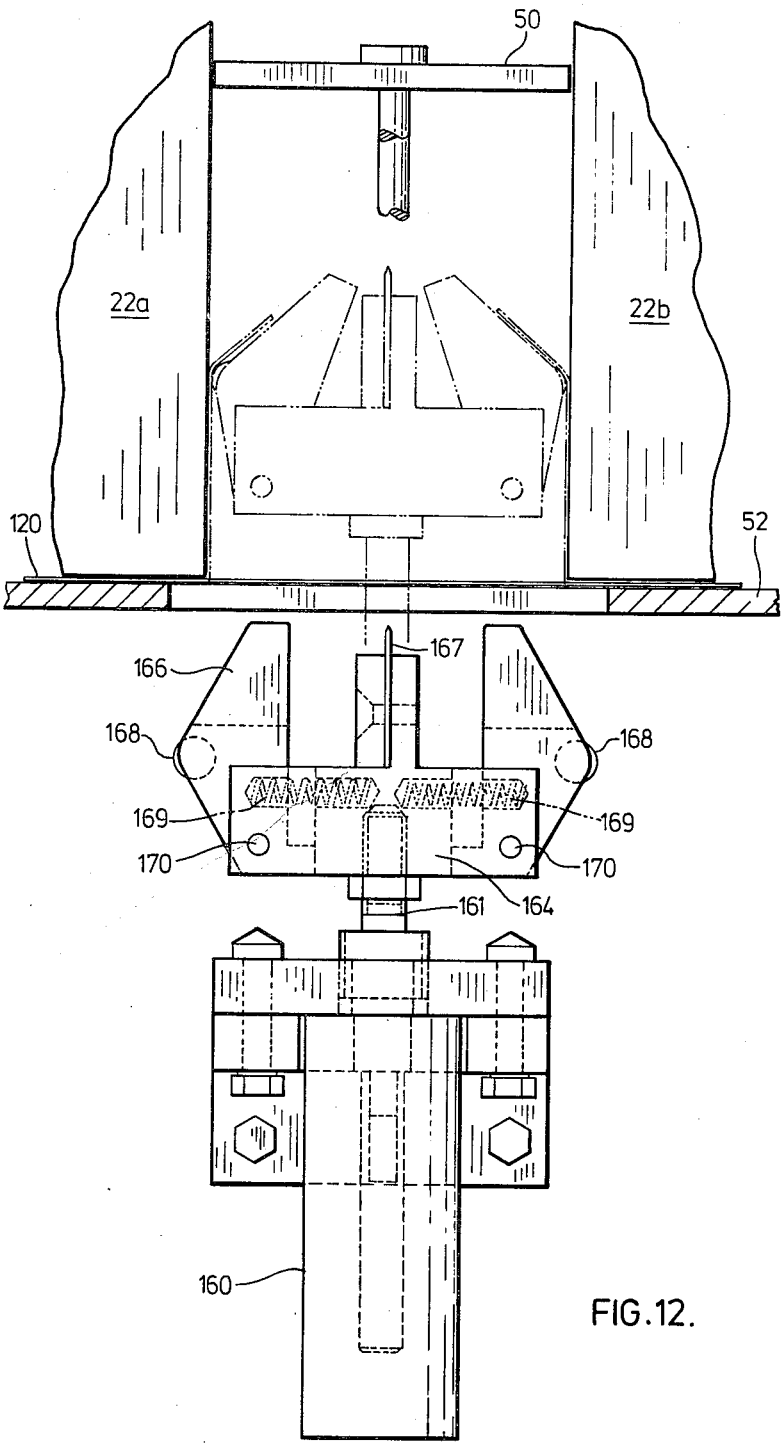
FIG. 12 is a side view of one embodiment of the tape plunger means.

FIG. 12 shows the tape plunger in greater detail. It includes a double acting hydraulic or pneumatically operated cylinder 160 having a piston 161 provided at its upper end with a base plate 164. Pivotally mounted on the base plate are a pair of triangular members 166, which are spring loaded by means of springs 169 to urge the triangular members to take the positions shown in FIG. 11. Roller members 168 are located at the apex of the triangular members. These rollers are recessed such that only their peripheries extend beyond the triangular members. Located between the triangular members is a central cutting edge or knife 167, the upper end of which is located slightly below the upper ends of the triangular members. As the tape plunger moves upwardly between stationary spaced apart adjacent cartons 22*b* and 22*c* supported to prohibit upper and outward movement by plates 50 and upper holding plate 54, the triangular members initially contact and apply tension to the strip of tape extending between the spaced apart cartons. As the plunger continues its upward movement, the triangular members contact the base of the cartons and start to pivot or fold inwardly about points 170. As this inwardly folding action continues, knife edge 167 becomes exposed to and cuts the tape between the cartons to provide a pair of free tape ends on opposite sides of the tape plunger as shown in FIG. 12. The plunger continues its upward movement with roller members 168 forcing the free tape ends against the opposing end walls of cartons 22*b* and 22*c*. Spring members 169 provide the outward pressure on the triangular blocks to assure that the free tape ends are securely fastened to the end walls by the roller members.

As mentioned above with the embodiment shown, approximately the first three inches of the bottom seam of carton 22*b* should be taped prior to activating the tape plunger. Therefore, the tape plunger should be located at least three inches downstream of the contact roller and the three inches of tape adhered to the bottom of carton 22*b* anchors it in place while completing the end wall taping. If the tape were not anchored in place, it would be unwound from the tape supply by the tape plunger during its upward travel and there would be no tension on the free tape end for effectively taping the downstream end wall of carton 22*b*. With this taping arrangement, no premeasuring of the tape is required since each carton unwinds its own supply of tape from the tape supply while being carried downstream by the conveyor. In instances where it is not possible to provide the approximate three inch strip of tape adhering to the underside of the upstream box to hold the strip of tape in position during the plunger operation, a brake may be provided on the tape supply reel 16. The brake would be activated coincident with the stopping of conveyor movement before actuation of the plunger. The brake would be released as soon as the box end taping operation was completed.

The carton blank is then advanced to the filling station 8 shown in FIG. 1, which incorporates a supply chute 100 for conveying goods 102 such as small coffee cream containers to the open topped carton blanks on the conveyor. A hopper member 104 is positioned at the end of the chute directly above the cartons to assure the filling of the appropriate carton. A hinged plate member 106 is secured to the hopper member directly across from the supply chute and acts as a back stop assuring guidance of the goods into the carton. When the cartoning apparatus is not in use, this plate member 106 may be moved to cover the hopper member and assure that no foreign objects enter the carton below the chute. A feed stop member 108 is located directly in front of the supply chute and is adapted to temporarily interrupt the supply of goods to the hopper as the conveyor is being moved. As can be appreciated, other types of supply chutes could readily be interchanged for that described above.

Figure 10:
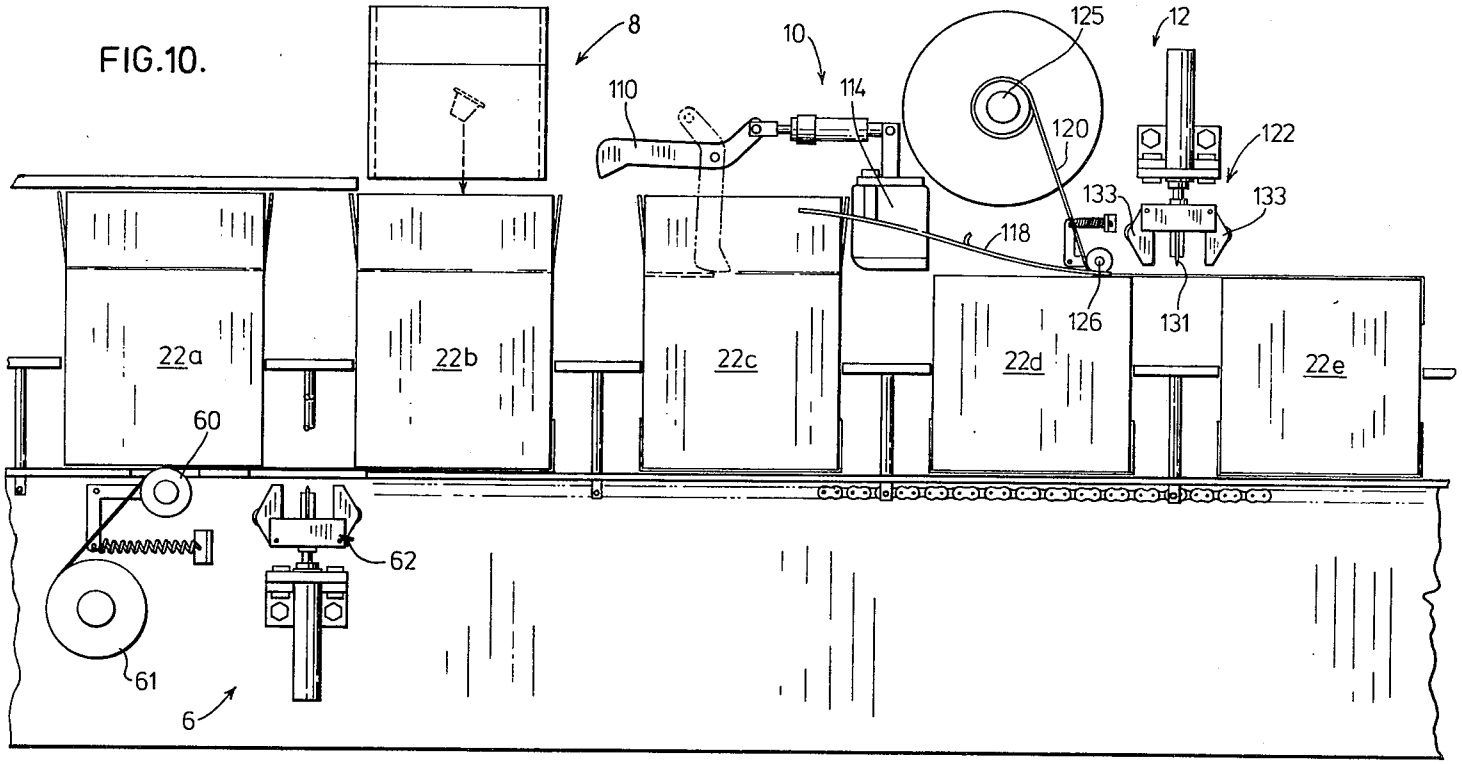
FIG. 10 is a side view of the conveyor showing a preferred arrangement of a taping apparatus, a filling station, a top flap closure station, and a top flap taping station.

The top folding and top taping station operates in essentially the same manner as the bottom folding and bottom taping system. However in this instance, the conveyor bed itself provides the vertical support since the pressure applied on a carton is now in a downward direction. Again there is no premeasuring of tape required. Referring to FIG. 10, rocker member 110 is pivoted to strike the trailing end flap of the carton top causing it to hinge and fold in place. The leading end wall flap is then folded downwardly by means of stationary abutment member 114 as the conveyor is advanced. The V-shaped side flap guide members 118 fold the side flaps in place and rocker member 110 is raised with the side flaps holding the end flaps in the folded position.

The upper taping system includes a free wheeling tape supply roller 125, a top tape contact roller 126 adapted to apply downward pressure through the provision of a similar type spring and bracket arrangement to that described with respect to the bottom taping system, and a tape plunger member generally indicated at 122.

As shown in FIG. 10, tape has been applied to the upper downstream end wall of carton 22*e* through a previous taping operation. This carton will unwind tape from the tape supply as it is advanced along the conveyor. The unwound tape is applied along the folded top of carton 22*e* and along approximately the first three inches of the top of carton 22*d* by the pressure contact roller 126, while the conveyor is in motion. The conveyor then stops at the point where tape plunger 122 is located directly above the gap between the spaced apart adjacent cartons. The tape plunger is operated to move downwardly with the triangular portions 133 of the plunger first coming into contact with and applying tension to the tape extending between the adjacent boxes. As the plunger continues its downward movement, triangular portions 133 are pivoted inwardly by the cartons until the cutting edge of knife 131 is exposed to and cuts the tape to provide a pair of free tape ends. The plunger completes its downward movement and the free tape ends are applied to the opposing end walls of the adjacent cartons by means of the peripheral rollers at the apex of the triangular portions. The plunger member is then withdrawn from the space between the cartons and the conveyor is advanced to complete the top folding and top taping of the next carton along the line.

It can therefore be seen that the system according to this invention minimizes the space requirements for carton set-up, carton bottom closure, filling and top closure operations. Due to the intermittent movement of the conveyor, the system operations of carton set-up at station 2, taping of carton end walls at station 6 and 12 and filling at station 8 are effected at the same time. Therefore, from a timing aspect for the overall system operation, the timing motor 5 ensures that all stations have completed their respective functions before restart of the conveyor movement.

It can also be appreciated that the taping system for closing the carton bottoms and tops provides for an automatic unattended operation. This is particularly important in cartoning systems where several filling stations may be involved, thereby allowing a single operator to oversee the operation of several cartoning apparatuses at one time. This is of course accomplished by providing a continuous length of sealing tape along the bottom seams of the boxes which as it extends between adjacent boxes, is severed and during the "stop" portion of conveyor operation the so formed tape free ends are applied against opposing box end walls.

Although various embodiments of the invention have been described herein in detail, it will be understood by those skilled in the art that variations may be made thereto without departing from the spirit of the invention and the scope of the appended claims.

What we claim is:

1. Carton forming and filling apparatus comprising means for supplying flat carton blanks to a set-up station; means for loading and means for opening a carton blank in the set-up station; conveyor means for intermittently conveying the open carton blanks and subsequently formed cartons in fixed spaced relation to one another; carton bottom forming means consisting of bottom folding means; means for taping the folded bottoms, means for restricting upward movement of the open carton blanks cooperating with the carton bottom forming means in forming the carton bottoms; carton filling means; carton top folding means; and top taping means for taping the folded carton tops, wherein the means for opening a carton blank consists of a separation member adapted to penetrate the carton blank, separate the carton sidewalls, and partially open the carton blank thereby causing a hinging action at the corner creases of the carton blanks between the carton end walls and sidewalls and a deflecting member positioned in the feed path to the set-up station for deflecting the carton end walls to complete the hinging action and fully open the carton blank.

2. A cartoning apparatus as defined in claim 1, wherein the means for loading the carton blank in the set-up station comprises a securing member for releasably securing the carton blank sidewalls and for moving the carton blank through the feed path past the deflecting member.

3. A cartoning apparatus as defined in claim 2, wherein said set-up station is adapted to accommodate the height of the carton blank prior to folding of the carton top and the carton bottom.

4. A cartoning apparatus as defined in claim 3, wherein the conveyor bed is depressed in the set-up station with a vertically reciprocable piston member positioned in the set-up station to force the carton blank downwardly into the depressed conveyor bed.

5. A cartoning apparatus as defined in claim 4, wherein the carton bottom folding means is provided in the depressed conveyor bed, said carton bottom folding means comprising a swinging arm member for folding the bottom trailing end flaps of the carton bottom, a fixed upwardly protruding member and fixed opposed inwardly tapering members for folding the bottom forward end flaps and bottom side flaps respectively as the carton blank is conveyed thereover.

6. A cartoning apparatus as defined in claim 2, wherein the securing member is hydraulically operated and provided with suction cups for releasably securing the carton blank sidewall.

7. A cartoning apparatus as defined in claim 6, wherein said separation member consists of a piston and cylinder assembly secured to the securing member, the piston of said assembly being aligned with an aperture provided in the carton blank sidewall releasably secured by the vacuum pads and being extendible therethrough to the opposite sidewall to partially open the carton blank and expose the end wall for deflection by the deflecting member.

8. Carton forming and filling apparatus comprising: means for supplying flat carton blanks to a set-up station; means for loading and means for opening a carton blank in the set-up station; conveyor means for intermittently conveying the open carton blanks and subsequently formed cartons in fixed spaced relation to one another; carton bottom forming means consisting of bottom folding means; means for taping the folded bottoms, means for restricting upward movement of the open carton blanks cooperating with the carton bottom forming means in forming the carton bottoms; carton filling means; carton top folding means; and top taping means for taping the folded carton tops, either of said taping means comprises a tape contact member and tape plunger means downstream of the tape contact member; the arrangement being such that said tape contact member applies a strip of tape along and extending between the folded tops of adjacent spaced apart cartons with said tape plunger being adapted to move into the space between the adjacent cartons when the conveyor is stationary to sever the extended strip of tape thereby provideing a pair of free tape ends and to apply the free tape ends to opposing end walls of the adjacent cartons.

9. An automatic cartoning apparatus as claimed in claim 8, wherein said tape contact member comprises a roller protruding into the path of movement of the cartons to press the tape along the folded carton tops.

10. An automatic cartoning apparatus as claimed in claim 8, wherein said tape plunger means comprises a pair of triangular end portions and a cutting edge located centrally of said triangular end portions.

11. An automatic cartoning apparatus as claimed in claim 9, wherein said tape plunger means is spaced downstream of said roller by at least three inches.

12. An automatic cartoning apparatus as claimed in claim 10, wherein said triangular end portions normally extend towards the strip of tape beyond the cutting edge and are adapted to cam inwardly as said tape plunger means moves between adjacent spaced apart cartons to expose the cutting edge to the strip of tape.

13. An automatic cartoning apparatus as claimed in claim 12, wherein the triangular end portions are spring loaded pivotally mounted on the tape plunger means and are provided with rollers for applying the free tape ends to the opposing end walls of the spaced apart cartons.

* * * * *